US011286877B2

(12) United States Patent
Boye et al.

(10) Patent No.: US 11,286,877 B2
(45) Date of Patent: Mar. 29, 2022

(54) METHODS FOR FORGING A PISTON BLANK

(71) Applicant: KS KOLBENSCHMIDT US, INC., Auburn Hills, MI (US)

(72) Inventors: David J. Boye, Brighton, MI (US); Bryan Quinn, Oxford, MI (US); Joseph Stojkov, Northville, MI (US); Joshua Cota, Peshtigo, WI (US); Scott D. Bailey, Roanoke, IN (US)

(73) Assignee: KS KOLBENSCHMIDT US, INC., Auburn Hills, MI (US)

( * ) Notice: Subject to any disclaimer, the term of this patent is extended or adjusted under 35 U.S.C. 154(b) by 369 days.

(21) Appl. No.: 16/279,394

(22) Filed: Feb. 19, 2019

(65) Prior Publication Data

US 2019/0178204 A1 Jun. 13, 2019

Related U.S. Application Data

(62) Division of application No. 15/064,150, filed on Mar. 8, 2016, now Pat. No. 10,253,722.

(60) Provisional application No. 62/155,803, filed on May 1, 2015, provisional application No. 62/155,869, filed on May 1, 2015.

(51) Int. Cl.

| | |
|---|---|
| ***F02F 3/16*** | (2006.01) |
| ***B21K 1/18*** | (2006.01) |
| ***B21J 5/08*** | (2006.01) |

(52) U.S. Cl.

CPC ..... *F02F 3/16* (2013.01); *B21J 5/08* (2013.01); *B21K 1/185* (2013.01); *F02F 2200/04* (2013.01)

(58) Field of Classification Search

CPC . F02F 3/16; F02F 2200/04; B21J 5/08; B21K 1/185

See application file for complete search history.

(56) References Cited

U.S. PATENT DOCUMENTS

| | | | | |
|---|---|---|---|---|
| 2,258,346 | A * | 10/1941 | Bell | B21J 13/10 72/405.15 |
| 6,763,757 | B2 | 7/2004 | Huang et al. | |
| 7,069,897 | B2 * | 7/2006 | Yanagimoto | B21K 1/18 123/193.6 |
| 7,918,022 | B2 | 4/2011 | Huang | |
| 9,782,823 | B2 * | 10/2017 | Grunert | B21J 13/025 |
| 2004/0168319 | A1 | 9/2004 | Mielke | |

(Continued)

FOREIGN PATENT DOCUMENTS

| | | | |
|---|---|---|---|
| DE | 102005029417 | A1 | 1/2006 |
| DE | 102005021428 | A1 | 11/2006 |

(Continued)

OTHER PUBLICATIONS

First Office Action for Chinese Patent Application No. 201610237636.7 dated Aug. 7, 2017.

(Continued)

*Primary Examiner* — Rick K Chang

(74) *Attorney, Agent, or Firm* — Howard & Howard Attorneys PLLC

(57) ABSTRACT

Methods for forging a piston blank are disclosed such that the forged piston blank is in a near-net shape and size of a final piston. Bending a flange to form a cooling channel can be done with reduced or no preliminary machining away of core material relative prior to bending the flange.

6 Claims, 3 Drawing Sheets

(56) References Cited

U.S. PATENT DOCUMENTS

| | | | |
|---|---|---|---|
| 2005/0283976 | A1 | 12/2005 | Otaka |
| 2015/0107106 | A1 | 4/2015 | Buschbeck et al. |

FOREIGN PATENT DOCUMENTS

| | | | |
|---|---|---|---|
| EP | 1452250 | A2 | 9/2004 |
| EP | 1614885 | A2 | 1/2006 |

OTHER PUBLICATIONS

Notification of Intention to Grant Patent Right for Invention for Chinese Patent Application No. 201610237636.7 dated Dec. 5, 2017.

* cited by examiner

METHODS FOR FORGING A PISTON BLANK

RELATED APPLICATIONS

This disclosure is a divisional of U.S. patent application Ser. No. 15/064,150 filed on Mar. 8, 2016, and claims the benefit of the filing date of U.S. provisional patent applications Ser. Nos. 62/155,869 and 62/155,803, both of which were filed on May 1, 2015.

TECHNICAL FIELD

The disclosure relates to improved methods for forging piston blanks and pistons resulting from such forged blanks using such methods.

BACKGROUND

Many piston blanks are currently forged in a manner that creates a heavy forged blank with a top-heavy flange. Such conventional piston blanks require substantial machining to cut away material to create a flange or collar over a recess such that the collar can then be bent to form a closed cooling channel. Methods for forming cooling channels in single-piece pistons are disclosed in U.S. Pat. Nos. 6,763,757 and 7,918,022, both of which are herein incorporated by reference in their entireties.

It would be desirable to forge a piston blank closer to the shape of a final piston, herein called a "near-net" shape. Conventionally, forging a piston blank to a near-net shape was considered difficult for a number of reasons. Forging involves high temperatures and brute force. Thus, it is somewhat counterintuitive that forging could lead to a predictable piston shape with predictable and repeatable dimensions as would be desired for a near-net shape piston blank. Additionally, forging near-net shape piston blanks with existing equipment presents substantial challenges to those of ordinary skill in the art.

Forging methods have been developed that may provide manufacturing and/or cost and efficiency advantages.

DETAILED DESCRIPTION

Figure 1:
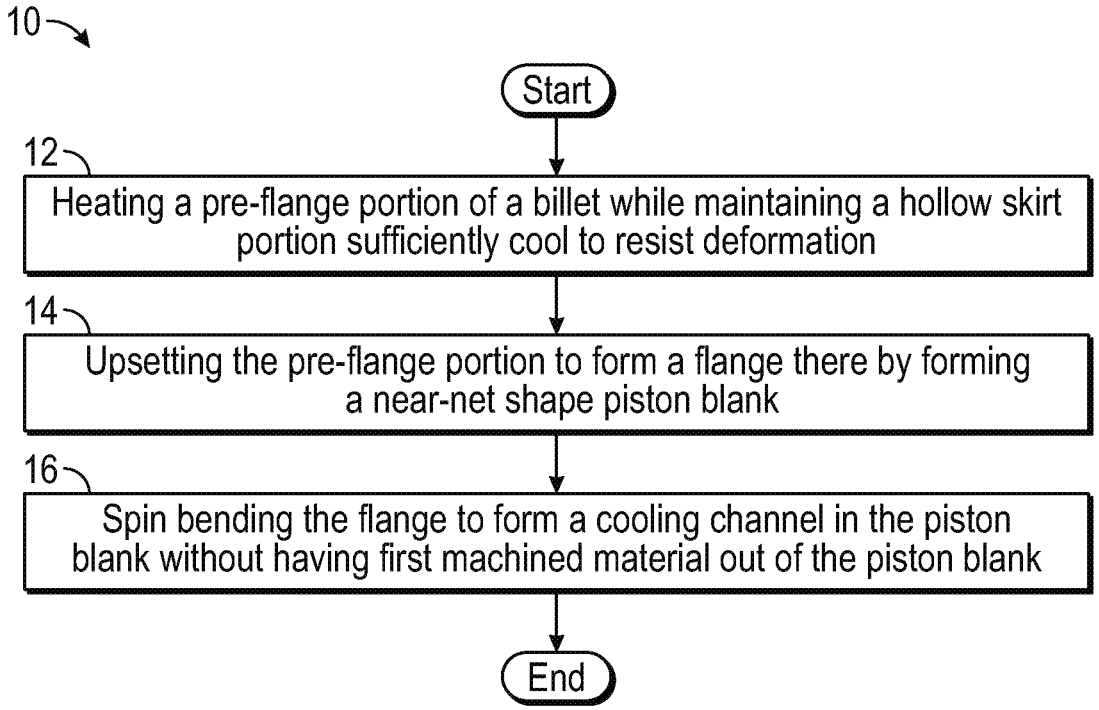
FIG. 1 is a flow chart of an exemplary forging process.

Referring to FIG. 1, an exemplary forging process 10 for a piston blank is described. The process provides a way to forge a reduced-mass billet into a near final shape and size piston blank that is ready for further processing to become a piston. Advantageously, the methods disclosed herein permit a cylindrical steel billet to be about 12 to 15% smaller than conventional billets. Also, because smaller starting masses in billets may be used, potentially providing savings. In one embodiment, the savings in mass of a steel billet for a piston in a class 8 vehicle are 1000 g to 1200 g of material.

Before step 12 begins, a billet has been heated, and pressed and shaped in a die to form a skirt portion and a pre-flange portion. The shaped billet may be allowed to cool in ambient air or otherwise actively cooled.

In step 12, the pre-flange portion of the shaped billet is heated. In this non-limiting example, the billet is steel, so the pre-flange portion is heated by induction heating to bring that portion of the steel billet to temperatures where steel can be deformed. In non-limiting example, induction heating is performed so that the steel skirt portion can retain or substantially retain its hollow cylindrical shape. Temperatures selected depend upon the specific material(s) of the shaped billet. Exemplary forming temperature for steel is at least about 1200° C.

Although heating in step 12 is not limited to induction heating, induction heating may provide benefits. Such benefits may include ease of localizing heating, thermal efficiency, shorter time to heat to desired temperatures, and more accurate temperature control. Additionally, if billets are outside of specification, such quality issues can be readily detected using this technique.

In step 14, the heated pre-flange portion is upset to form a flange. Upsetting involves displacing by applied pressure from one or more dies applied acting on the ore-flange portion, causing material in the conical portion to flow outwardly and form a flange (or collar) over a recess. This creates a piston blank in a near net shape. A cooling channel can be formed without removing material from a core between the flange and the skirt, by machining or other methods.

In step 16, the flange can then be bent, including by spin bending (also referred to as spin forming), to form a closed cooling channel in the piston.

Figure 2:
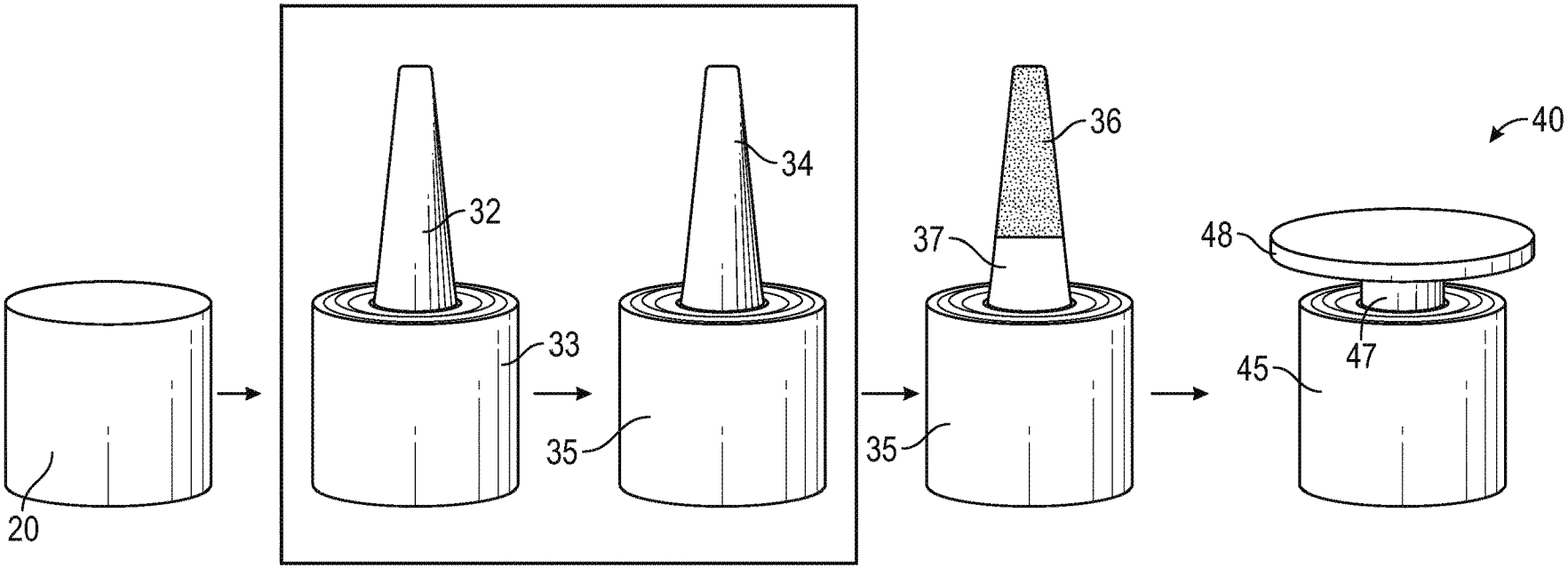
FIG. 2 shows a billet through exemplary shaping processes.

Referring to FIG. 2, a schematic shows how cylindrical billet 20 is processed before and during the steps identified in FIG. 1. In this non-limiting example, billet 20, using an appropriate die or combination of dies, is heated and forged into a preform shape with a substantially conical pre-flange portion 32 and a base or skirt portion 33. In the example of FIG. 2, it takes two hits to shape skirt portion 35 and pre-flange portion 34. It is contemplated that fewer or greater hits may be used to achieve the desired shapes. Both portions 35 and 34 are formed substantially simultaneously, reducing the formation of flash at the parting between the dies at a skirt tip. This may help control the mass of the forging, enabling substantially consistent material savings in production.

Next, the shaped billet is selectively heated. In the non-limiting example, pre-flange portion 36 is induction heated so its material is deformable, while maintaining a temperature of skirt portion 35 sufficiently low so it may retain its shape or substantially retain its shape while pre-flange portion 36 is manipulated and deformed.

In addition to or in connection with induction heating, using heating/cooling cycles may also control what portions of the piston blank are heated to what extent. The number of, duration of and temperatures for such cycles may vary depending upon the geometry and the materials used in a particular piston.

Between pre-flange portion 36 and skirt portion 36 is core 37. Core 37 acts as the inner track around which a cooling channel will be formed.

Next, an upsetting process causes pre-flange portion 36 to form a flange 48 for piston blank 40 in a near net shape. Core 47 is flanked by skirt 45 and flange 48. In some embodiments, flange 48 can be spin bent to create a cooling channel without the need for any machining to remove material from core 47. In some embodiments, reduced preliminary machining may be performed prior to spin bending flange 48. In such embodiments, the machining to be performed will be substantially less than the machining performed using conventional piston blanks.

The upsetting process can be one, two or more steps. That is, one or more dies may be applied against a heated pre-flange portion 36 and cause displacement of material until a collar or flange is formed above a recess. The one or more dies may engage in a single pass or multiple passes on the pre-flange portion 36. Optionally, removable dies can be placed near the pre-flange portion 36 such that when upsetting occurs, the removable dies direct material flow away from a recessed region that will become the cooling channel. When the optional dies are removed, the recess remains where the dies were with a collar or flange atop the recess to be bent to form the closed cooling channel.

Figure 3:
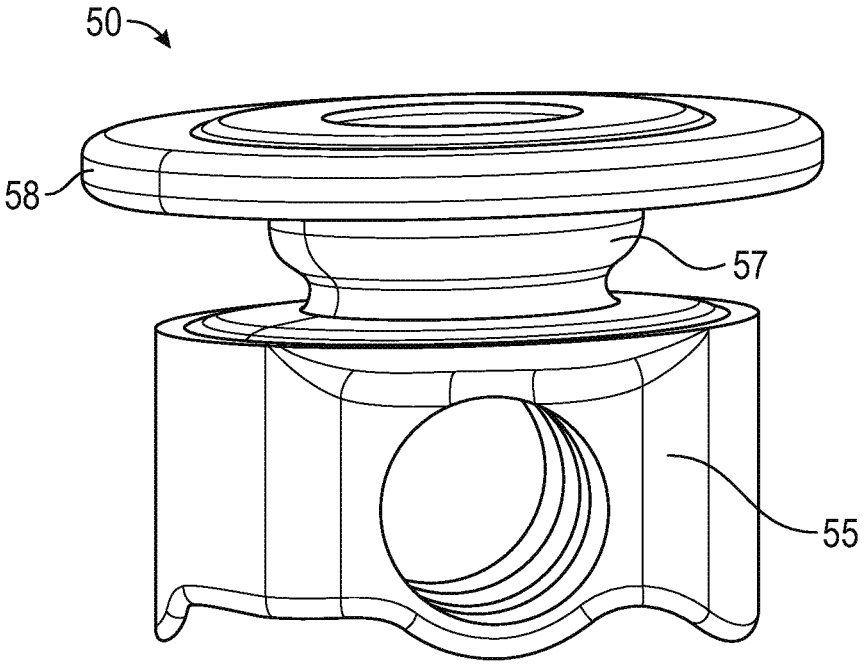
FIG. 3 shows an exemplary forged near-net shape piston blank.

FIG. 3 shows an exemplary single piece forged near-net shape piston blank 50, with skirt 55 and flange 58. Flange 58 can be bent to form a cooling channel around core 57. Though material may be moved, little or no pre-machining may be done to remove material from the core 57 in advance of the bending.

Figure 4:
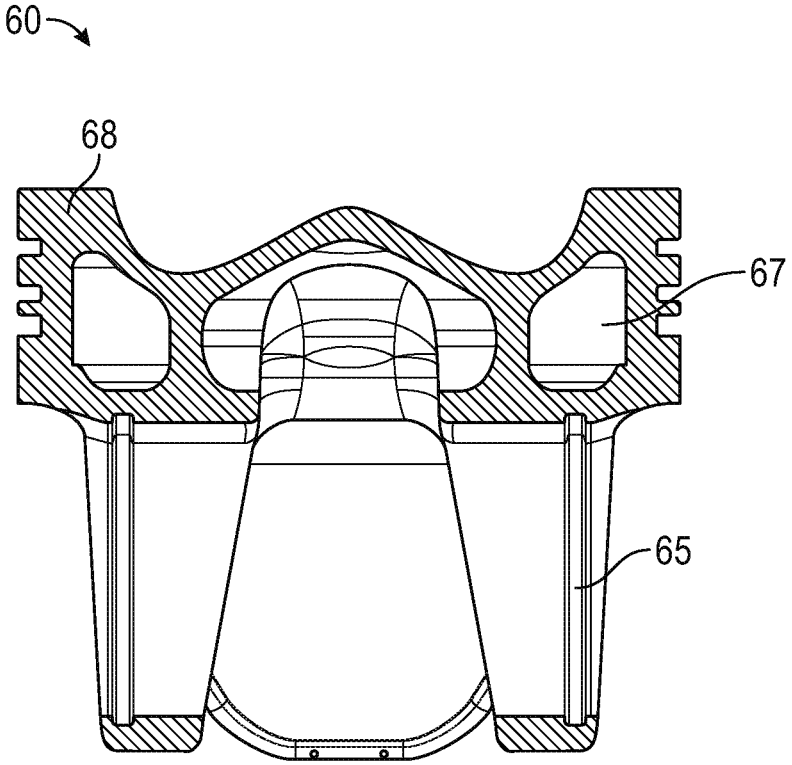
FIG. 4 shows an exemplary single-piece piston.

FIG. 4 shows another exemplary singe piece forged near-net shape piston blank 60. Flange 68, above skirt 65, has been bent by spin forming to form cooling channel 67.

With regard to the processes described, it should be understood that, although the steps of such processes have been described as occurring in a certain sequence, such processes could be practiced with the described steps performed in a different order. It should be understood that certain steps could be performed simultaneously, that other steps could be added, or that certain steps could be omitted.

The entirety of the above description is intended to be merely illustrative. Many embodiments and applications other than the examples provided would be apparent upon reading the above description. The scope of the invention should be determined with reference to the appended claims along with the full scope of equivalents. It is anticipated that future developments will occur, and that the disclosed devices and processes used with such future developments. That is, the invention is capable of variation.

All terms used in the claims are intended to be given their ordinary meanings as understood by those knowledgeable in the described technologies unless an explicit indication to the contrary is made. Also, singular articles such as "a," "the," "said," should be understood to recite one or more of the indicated nouns unless a claim explicitly states otherwise.

What is claimed as new and desired to be protected by Letters Patent of the United States is:

1. A method for forging a piston blank to a near-net shape having a cooling channel formed from a flange which, in turn, is formed from a pre-flange and a skirt portion depending from the flange, the method comprising:

heating a billet;

while heated, shaping the billet by at least one hit in a die;

allowing cooling of the shaped billet;

heating a pre-flange portion of the shaped billet while maintaining a skirt portion at a temperature sufficiently cool to retain the shape of the shirt portion; and upsetting the pre-flange portion of the billet to form a flange, thereby forming a piston blank having a near-net shape, wherein the piston blank having the flange opposite the skirt portion, the flange being spin-bendable to form a cooling channel without preliminary removal of material.

2. A method for forging a piston blank to a near-net shape having a cooling channel formed from a flange which, in turn, is formed from a pre-flange and a skirt portion depending from the flange, the method comprising:

heating a steel billet;

while heated, shaping the billet to form a pre-flange portion and a skirt portion;

cooling the shaped billet;

heating the pre-flange portion to a temperature permitting deformation while maintaining the skirt portion at a temperature substantially resisting deformation;

upsetting the pre-flange portion of the billet to form a flange spaced apart from the skirt, thereby forming a piston blank having a near-net shape, wherein the flange spaced apart from the skirt portion comprises a steel core between the flange and the skirt portion, and the flange being spin-bendable to form a cooling channel without preliminary removal of material from the steel core.

3. The method of claim 2, wherein the pre-flange portion has a shape that is generally conical.

4. The method of claim 2, wherein the step of shaping the billet comprises a plurality of hits in a die.

5. The method of claim 2, further comprising the step of spin bending the flange without prior machining of the steel core to remove material to form a cooling channel in the piston blank.

6. A method for forging a one-piece piston blank to a near-net shape having a cooling channel formed from a flange which, in turn, is formed from a pre-flange and a skirt portion depending from the flange, the method comprising:

heating an entirety of a steel billet;

shaping the billet to form (a) a pre-flange portion wherein at least a region of the pre-flange portion has a conical-like shape and (b) a hollow skirt portion;

cooling the shaped billet;

heating the pre-flange portion to temperatures permitting deformation while maintaining the skirt portion at a temperature preventing substantial deformation; and upsetting the pre-flange portion of the billet to form a flange spaced apart from the hollow skirt portion with a steel core between the flange and the hollow skirt while the hollow skirt retains its shape, thereby forming a piston blank having a near-net shape, wherein the flange is spin-bendable to form a cooling channel without preliminary removal of material from the steel core by machining.

* * * * *